US009379437B1

(12) United States Patent
Stutzke et al.

(10) Patent No.: US 9,379,437 B1
(45) Date of Patent: Jun. 28, 2016

(54) CONTINUOUS HORN CIRCULAR ARRAY ANTENNA SYSTEM

(75) Inventors: Nathan A. Stutzke, Westminster, CO (US); Peter J. Moosbrugger, Erie, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 1305 days.

(21) Appl. No.: 13/018,145

(22) Filed: Jan. 31, 2011

(51) Int. Cl.

| | |
|---|---|
| ***H01Q 3/24*** | (2006.01) |
| ***H01Q 3/36*** | (2006.01) |
| ***H01Q 21/00*** | (2006.01) |
| ***H01Q 21/29*** | (2006.01) |
| ***H01Q 23/00*** | (2006.01) |

(52) U.S. Cl.
CPC ..... *H01Q 3/242* (2013.01); *H01Q 3/36* (2013.01); *H01Q 21/0006* (2013.01); *H01Q 21/29* (2013.01); *H01Q 23/00* (2013.01)

(58) Field of Classification Search
CPC ..... H01Q 3/242; H01Q 3/36; H01Q 21/0006; H01Q 21/29; H01Q 23/00
USPC ..... 343/772, 776, 777, 778, 786
See application file for complete search history.

(56) References Cited

U.S. PATENT DOCUMENTS

| | | | |
|---|---|---|---|
| 3,090,956 | A | 5/1963 | Woodward, Jr. et al. |
| 3,116,485 | A | 12/1963 | Carson |
| 3,569,976 | A | 3/1971 | Korvin et al. |
| 3,775,773 | A | 11/1973 | Nemit |
| 3,887,926 | A | 6/1975 | Schwartz et al. |
| 4,127,857 | A | 11/1978 | Capps et al. |
| 4,359,738 | A | 11/1982 | Lewis |
| 4,423,422 | A | 12/1983 | Knop et al. |
| 4,630,062 | A | 12/1986 | Dewey |
| 4,673,943 | A | 6/1987 | Hannan |
| 4,825,222 | A | 4/1989 | Butcher |
| 4,890,117 | A | 12/1989 | de Ronde |
| 5,023,594 | A | 6/1991 | Wallace |
| 5,202,697 | A | 4/1993 | Bonebright et al. |

(Continued)

FOREIGN PATENT DOCUMENTS

| | | |
|---|---|---|
| DE | 27 14 643 A1 | 2/1978 |
| EP | 0 456 034 A2 | 11/1991 |

(Continued)

OTHER PUBLICATIONS

Mussler, Michael. E., U.S. Appl. No. 13/018,146, Entitled "Conical Switched Beam Antenna Method and Apparatus", filed Jan. 31, 2011, 30 pages.

(Continued)

*Primary Examiner* — Robert Karacsony
(74) *Attorney, Agent, or Firm* — Sheridan Ross P.C.

(57) ABSTRACT

A continuous horn or flared radiator antenna system is provided. The antenna system provides for steering a beam within at least a first plane (e.g., in azimuth). Steering a beam includes selecting an operative portion or segment of a circular array of elements or probe feeds. Steering can also include electronically steering the resulting beam within a coverage area provided by the selected segment of probe feeds. The electronic steering within the coverage area can be performed through the selective operation of phase shifters. Multiple continuous horn radiator structures can be provided to support pointing or steering of a beam in a second plane (e.g., in elevation), operation in multiple frequency bands, and/or simultaneous transmission and reception of signals.

17 Claims, 12 Drawing Sheets

(56) References Cited

U.S. PATENT DOCUMENTS

| | | | | |
|---|---|---|---|---|
| 5,506,592 | A | 4/1996 | MacDonald et al. | |
| 5,714,964 | A * | 2/1998 | Jackson | 343/786 |
| 5,742,257 | A | 4/1998 | Hadden et al. | |
| 6,023,246 | A | 2/2000 | Tanabe | |
| 6,104,346 | A | 8/2000 | Rudish et al. | |
| 6,317,096 | B1 | 11/2001 | Daginnus et al. | |
| 6,353,418 | B1 | 3/2002 | Burger et al. | |
| 6,384,795 | B1 | 5/2002 | Bhattacharyya et al. | |
| 6,452,565 | B1 | 9/2002 | Kingsley et al. | |
| 6,816,118 | B2 | 11/2004 | Kingsley et al. | |
| 6,900,764 | B2 | 5/2005 | Kingsley et al. | |
| 6,987,489 | B2 | 1/2006 | Melconian et al. | |
| 7,012,572 | B1 | 3/2006 | Schaffner et al. | |
| 7,081,858 | B2 * | 7/2006 | Miles | 343/754 |
| 7,307,596 | B1 | 12/2007 | West | |
| 7,728,772 | B2 | 6/2010 | Mortazawi et al. | |
| 8,581,794 | B1 * | 11/2013 | Shor et al. | 343/776 |
| 2002/0167449 | A1 | 11/2002 | Frazita et al. | |
| 2003/0052831 | A1 | 3/2003 | Knop et al. | |
| 2004/0085249 | A1 | 5/2004 | Kitamori et al. | |
| 2005/0200531 | A1 | 9/2005 | Huang et al. | |
| 2005/0219126 | A1 | 10/2005 | Rebeiz et al. | |
| 2006/0071876 | A1 | 4/2006 | Clymer et al. | |
| 2007/0252768 | A1 | 11/2007 | Mohamadi | |
| 2008/0055175 | A1 | 3/2008 | Rebeiz et al. | |
| 2008/0100523 | A1 | 5/2008 | Kim et al. | |
| 2008/0117113 | A1 | 5/2008 | Haziza | |
| 2009/0237318 | A1 | 9/2009 | Brown | |
| 2009/0267852 | A1 | 10/2009 | Tahmisian, Jr. et al. | |
| 2009/0309801 | A1 | 12/2009 | Rao et al. | |
| 2010/0013726 | A1 | 1/2010 | Matthews et al. | |
| 2010/0052987 | A1 | 3/2010 | Weinstein | |
| 2010/0066590 | A1 | 3/2010 | Brown et al. | |
| 2010/0164784 | A1 | 7/2010 | Longstaff | |
| 2010/0207819 | A1 | 8/2010 | Uhl et al. | |

FOREIGN PATENT DOCUMENTS

| | | | |
|---|---|---|---|
| GB | 1011303 | | 11/1965 |
| GB | 1505375 | | 3/1978 |
| GB | 2258345 | A | 2/1993 |
| GB | 2 355 855 | A | 5/2001 |
| JP | 2000 138521 | A | 5/2000 |
| WO | WO 00/01031 | A1 | 1/2000 |
| WO | WO 00/76028 | A1 | 12/2000 |
| WO | WO 01/28162 | A1 | 4/2001 |
| WO | WO 01/69720 | A1 | 9/2001 |
| WO | WO 03/098740 | A1 | 11/2003 |

OTHER PUBLICATIONS

International Preliminary Report on Patentability for International Application No. PCT/US2011/060564, mailed Aug. 6, 2013, 10 pages.

International Preliminary Report on Patentability for International Application No. PCT/US2011/060571, mailed Aug. 6, 2013, 7 pages.

Official Action for U.S. Appl. No. 13/018,146, mailed Apr. 17, 2013, 6 pages (Restriction Requirement).

Official Action for U.S. Appl. No. 13/018,146, mailed Jun. 14, 2013, 8 pages.

Inoue et al., "Horn-Array Type Electrically Despun Antenna for the 11-GHz Band", Electronics and Communications in Japan, vol. 53-B, No. 7, 1970, 8 pages.

International Search Report and Written Opinion for International Application No. PCT/US2011/060564, mailed Mar. 6, 2012, 16 pages.

International Search Report and Written Opinion for International Application No. PCT/US2011/060571, mailed Feb. 29, 2012, 12 pages.

Notice of Allowance for U.S. Appl. No. 13/018,146, mailed Sep. 27, 2013, 9 pages.

* cited by examiner

CONTINUOUS HORN CIRCULAR ARRAY ANTENNA SYSTEM

FIELD

A continuous horn circular array antenna system that is electronically steerable 360° in a first plane is provided.

BACKGROUND

Many communication systems require a low profile aperture antenna that can be easily conformed to an existing structure, such as the skin of an aircraft, or concealed beneath a surface, that can be used on a moving vehicle, and that can provide a steered beam. In the past, monolithic microwave integrated circuit (MMIC) or other electronically scanned or steered planar phased arrays have been used for such applications because they provide a low profile aperture. The usual reasons why an electronic phased array may be selected for a particular application include the phased array's ability to provide high speed beam scanning and meet multi-beam/multi-function requirements.

Unfortunately, there are several disadvantages associated with implementing an electronically steered planar phased array. The most notable disadvantage is that electronically steered planar phased arrays are very costly, since the amplitude and phase at each point in the aperture is controlled discretely. Additionally, providing full 360° azimuth coverage with a planar phased array requires either a multi-faced system which increases cost, or a single-face system that mechanically rotates which increases mass and degrades reliability. As a result, commercial exploitation of electronically steered phased arrays has been limited. Instead, the use of electronically steered phased arrays is generally confined to applications where minimizing cost is not necessarily of the highest priority. However, for most commercial applications mitigating costs is a high priority when implementing antennas or other devices.

An alternative to electronically steered phased array antennas is a mechanically steered antenna. Mechanically steered antennas include directional antennas, such as dishes, that are mechanically moved so that they point towards the endpoint that they are exchanging communications with. Other examples of mechanically steered antennas include antennas with beams that can be steered by rotating one or more lenses that intersect the antenna's beam. However, directional antennas that are mechanically steered often have a relatively high profile, and are therefore unsuitable for applications requiring a low-profile antenna. An antenna with a mechanically steered lens assembly can suffer from increased losses due to the inclusion of the lens elements and, like other systems that include mechanically steered components, can be prone to mechanical failure.

Still another alternative is to substitute an antenna with an omni-directional beam pattern for an antenna with a beam that can be steered. However, many antenna designs that produce a suitable omni-directional beam pattern have a relatively high profile. In addition, the gain of such systems for a particular antenna size or configuration can be inadequate for certain applications. Moreover, for particular applications, it may be undesirable to utilize an omni-directional beam pattern.

For these reasons, there exists a need for a method and apparatus that provides a relatively inexpensive, reliable, and low profile antenna displaying high quality beam steering capabilities.

SUMMARY

The present invention is directed to solving these and other problems and disadvantages of the prior art. In accordance with embodiments of the present invention, an antenna system featuring a continuous horn or flared radiator is provided. More particularly, an antenna system with an aperture comprising a circular flared radiator aperture that is continuous about a circumference of the flared radiator is provided. Accordingly, the radiator provided by embodiments of the present invention comprises a flared radiator that has been revolved around a center axis. The antenna system additionally includes a circular array that includes probe feeds arranged around a circle that coincides with a parallel plate waveguide portion of the flared radiator aperture. Probe feeds within selected segments or areas of the circle can be operated selectively, to provide steering of the beam in a plane parallel to the plane or base plate of the antenna. In addition, a beam produced by probe feeds within selected segments can be electronically steered, to provide fine pointing of the beam. The antenna system provides a narrow beam in the plane parallel to the base plate of the antenna and a broad fan-beam perpendicular to the base plate of the antenna.

In accordance with embodiments of the present invention, the continuous horn or flared radiator of the antenna system includes a wave guide portion and a flared radiator portion. Moreover, the wave guide portion may comprise a parallel plate wave guide. Within the wave guide portion, a plurality of probe feeds are disposed. The plurality of probe feeds may be arranged about a circle that is concentric with the continuous flared radiator. In addition, each probe feed in the plurality of probe feeds may be interconnected to a feed network. As used herein, unless explicitly stated otherwise, a "feed network" can refer to a receive only system, a transmit only system, a half duplex system, or a full duplex system. The feed network is operated to selectively activate a subset of the probe feeds at a time. By thus controlling the activation of subsets of the probe feeds, steering of the beam associated with the continuous horn antenna can be controlled. In particular, the beam can be steered in a plane that is parallel to the plane of the base plate and/or the parallel plate waveguide portion of the antenna system. For example, segments that encompass probe feeds along some number of degrees of arc of the continuous flared radiator can be operated at any one point in time, allowing the beam to be steered in like increments. Although segments or sectors of any size can be used, example segment sizes include 45°, 30° or 15°. Switches included in the feed network can be operated to select any two adjacent segments for operation at a point in time. In accordance with further embodiments, phase shifters are provided such that a beam of the antenna system can be electronically steered within at least some portion of the active or adjacent segments. For example, where two adjacent 45° sectors are active simultaneously to produce a 45° coverage area, phase shifters can be provided to steer the beam within a range of ±22.5°. Accordingly, a hybrid switched/electronically steered antenna system is provided.

In accordance with further embodiments, an antenna system featuring multiple continuous horn radiator structures or elements, also referred to herein as continuous flared radiator structures, can be stacked about a common axis. Moreover, where the different continuous flared radiator structures provide different patterns in elevation, steering of a beam of the antenna system in a plane perpendicular to a base plate of the antenna system can be accomplished by appropriate selection of the active continuous flared radiator structure. Embodiments with multiple continuous flared radiator structures can also facilitate support for simultaneous transmit and receive operations, and/or support for multiple frequency ranges. In accordance with still other embodiments, supplemental antenna elements can be provided such that a fuller coverage pattern is achieved. For instance, one or more supplemental antenna elements can be disposed within a circumference defined by the continuous horn radiator, to provide coverage along or more nearly along the axis of the continuous horn radiator. Such one or more supplemental antenna elements can comprise one or more patch elements. Additionally, phase shifters may be used to provide a steerable beam with these supplemental antenna elements.

A feed network in accordance with embodiments of the present invention can include switches for selectively operating probe feeds. More particularly, the feed network can comprise a plurality of four-way switches. Moreover, each of the four-way switches can be formed using a set of three transmit/receive switches. Additional components that can be provided as part of a feed network include low noise amplifiers, power amplifiers, phase shifters, and limiters. In addition, the feed network can be configured to provide splitters/combiners.

Methods in accordance with embodiments of the present invention include disposing a plurality of feed probes within a waveguide region of a flared radiator, and selectively operating a subset of the plurality of feed probes to control the steering of an antenna beam. In accordance with further embodiments of the present invention, the method may include operating feed probes over some number of degrees of arc at any one point of time through the selective operation of switches. In accordance with further embodiments, the beam can additionally be steered using phase shifters. For example, and without limitation, the method may include operating probe feeds over a 90° arc which can be centered in 45° increments at any one point in time through the selected operation of switches. In accordance with further embodiments of the present invention, the resulting beam can be pointed within a selected 45° arc by ±22.5° electronically. Methods in accordance with embodiments of the present invention can also include providing and selectively operating a plurality of concentric continuous flared radiator structures as described herein to provide support for multiple frequency bands and/or steering of the beam in elevation.

DETAILED DESCRIPTION

Figure 1:
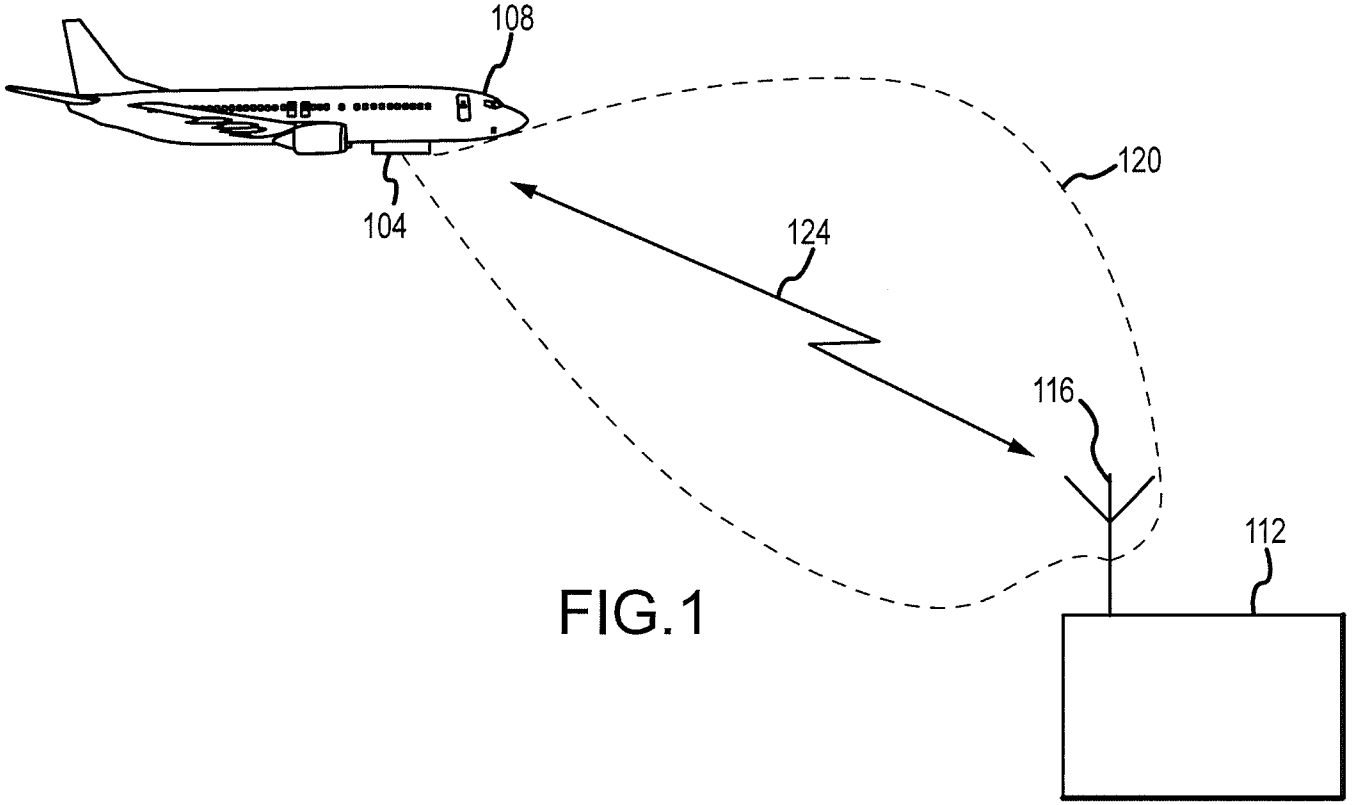
FIG. 1 depicts an antenna system in accordance with embodiments of the present invention in an exemplary operating environment.

FIG. 1 illustrates an antenna system 104 in accordance with embodiments of the present invention, in an exemplary operating environment. In particular, the antenna system 104 is shown mounted to a platform 108. In this example, the platform 108 comprises an airplane. However, an antenna system 104 in accordance with embodiments of the present invention can be associated with any type of platform 108, whether that platform 108 comprises a vehicle, stationary structure, or other platform. In general, the antenna system 104 operates to transmit and/or receive information relative to an endpoint 112. Moreover, the endpoint 112 can itself include or be associated with an endpoint antenna 116. Endpoint 112 can be a stationary structure or a mobile platform. Accordingly, data can be exchanged between the antenna system 104 and the endpoint antenna 116. Although the example environment illustrated in FIG. 1 depicts communications between two cooperating endpoints, embodiments of the present invention can also be used in other scenarios. For example, an antenna system 104 can be used as a sensor or beacon.

In one particular application, the antenna system 104 is used to receive control information from a ground station or endpoint 112 related to the operation of an associated platform 108. Alternatively or in addition, the antenna system 104 can be used to transmit telemetry information, environmental information, or information gathered from sensors mounted to the platform 108 to the endpoint 112. Moreover, in accordance with embodiments in which the platform 108 is moving relative to the endpoint 112, the ability of the antenna system 104 in accordance with embodiments of the present invention to steer an associated beam 120 is desirable. The beam 120 of the antenna system 104, which can, for example, support wireless transmission line 124, can be steered in at least one plane, to maximize or increase the gain of the antenna system 104 relative to the endpoint antenna 116. For example, the antenna system 104 can be mounted such that the beam 120 produced by the antenna system 104 can be steered in azimuth. Although depicted in the figure as a static element, as an alternative or in addition to a static element, the antenna 116 associated with the endpoint 112 can comprise an antenna system 104 in accordance with embodiments of the present invention, a phased array antenna system, a mechanically steered antenna system, or other antenna system.

Figure 2:
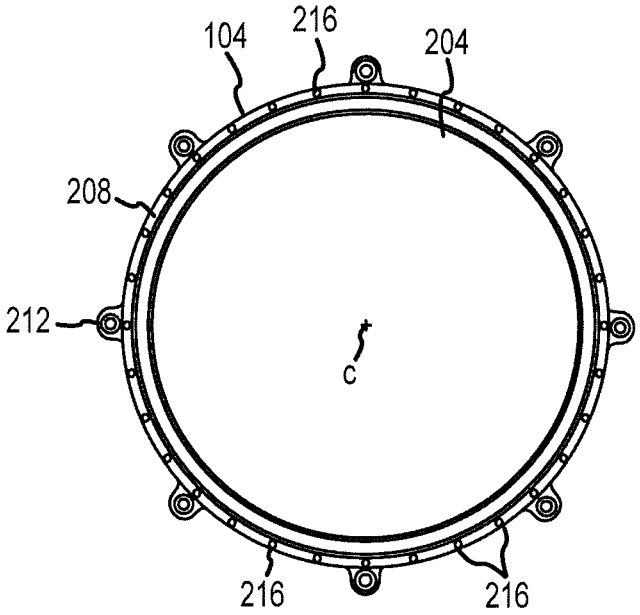
FIG. 2 is a plan view of an antenna system in accordance with embodiments of the present invention.

FIG. 2 depicts an antenna system 104 in accordance with an exemplary embodiment of the present invention in plan view. In general, the antenna system 104 may have a circular configuration, according to which at least some of the components of the antenna system 104 are disposed symmetrically about a center point C, defining a central axis. Visible in the figure is radome 204, and a portion of a base plate 208. As shown, the base plate 208 can include mounting members 212, to facilitate mounting the antenna system 104 to a platform 108. In addition, the radome 204 can be interconnected to the base plate 208 by a plurality of fasteners 216.

Figure 3:
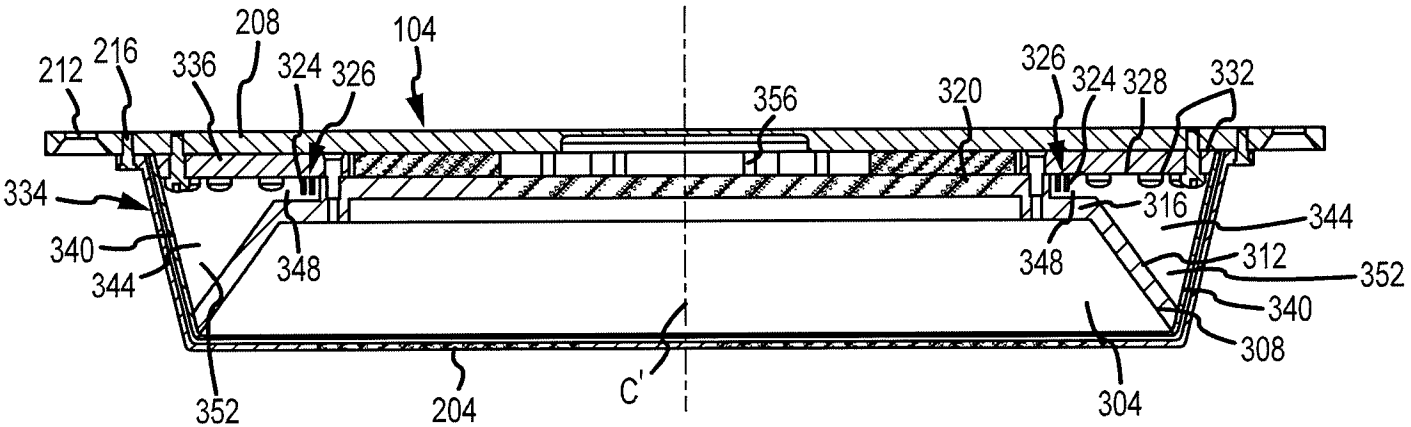
FIG. 3 is a cross-section in elevation of an antenna system in accordance with embodiments of the present invention.

FIG. 3 is a cross-section in elevation of an antenna system 104 in accordance with an exemplary embodiment of the present invention. In general, the radome 204 cooperates with the base plate 208 to define an enclosed volume 304. As can be appreciated by one of skill in the art after consideration and appreciation of the present disclosure, a radome 204 is not required as part of the antenna system 104. However, a radome 204 can be desirable, for example where the antenna system 104 is mounted to the exterior of a platform 108. A horn structure or flared radiator 308 is interconnected to the base plate 208. In general, the horn structure 308 includes a flared radiator portion 312, a wave guide portion 316, and a central or mounting portion 320. The flared radiator 312, wave guide 316, and mounting 320 portions of the horn structure 308 shown in cross-section in FIG. 3 are continuous such that they form a generally circular structure centered about the central axis C' of the antenna system 104. Moreover, the horn structure 308 is generally symmetric about the central axis C'.

A plurality of probe feeds 324 are disposed adjacent to or within the wave guide portion 316 of the horn structure 308 to form a circular array 326. In accordance with embodiments of the present invention, the probe feeds 324 are mechanically and electrically interconnected to a printed circuit board (PCB) 328. The printed circuit board 328 is generally parallel to the base plate 208, and may be interconnected to the base plate 208 directly, or through and intermediate component or components, such as a stiffener or spacer 336. The PCB 328 may comprise some or all of a ground plane 332. Alternatively or in addition, the base plate 208 may comprise some or all of a ground plane 332. As can be appreciated by one of skill in the art, after consideration of the present disclosure, the horn structure 308, in combination with the ground plane 332, forms an aperture comprising a continuous horn or flared radiator structure 334 that extends 360° about the central axis C' of the antenna system 104. Moreover, the horn structure 308 and the ground plane 332 define an aperture volume 344. This aperture volume 344 includes a parallel plate waveguide portion 348 that is generally between the waveguide portion 316 of the horn structure 308 and the ground plane 332, and a flared radiator portion 352 that is generally between the waveguide 316 of the horn structure 308 and the ground plane 332.

An antenna system 104 in accordance with embodiments of the present invention can also include a feed network that is at least partially incorporated into and/or associated with the PCB 328. As described further elsewhere herein, the feed network generally functions to operate a selected subset or subsets of the plurality of probe feeds 324 disposed along a segment or arc of the circular array 326 at different points in time. The feed network can also include phase shifters, to allow for steering of the beam produced by the selected probe feeds 324 within a selected segment. In addition, as can be appreciated by one of skill in the art, a horn type antenna will radiate a linearly polarized wave. Therefore, if circular polarization is desired, or if circularly polarized waves are received, a polarizer 340 can be mounted about the perimeter of the circular aperture adjacent the flared radiator portion 352 of the aperture volume 344, to transition between a linearly polarized wave and a circularly polarized wave. Alternatively, polarizer 340 can be mounted to radome 204 and spaced away from the flared radiator portion 352. Fasteners 356 can be used to interconnect the various components of the antenna system 104 to one another.

Figure 4:
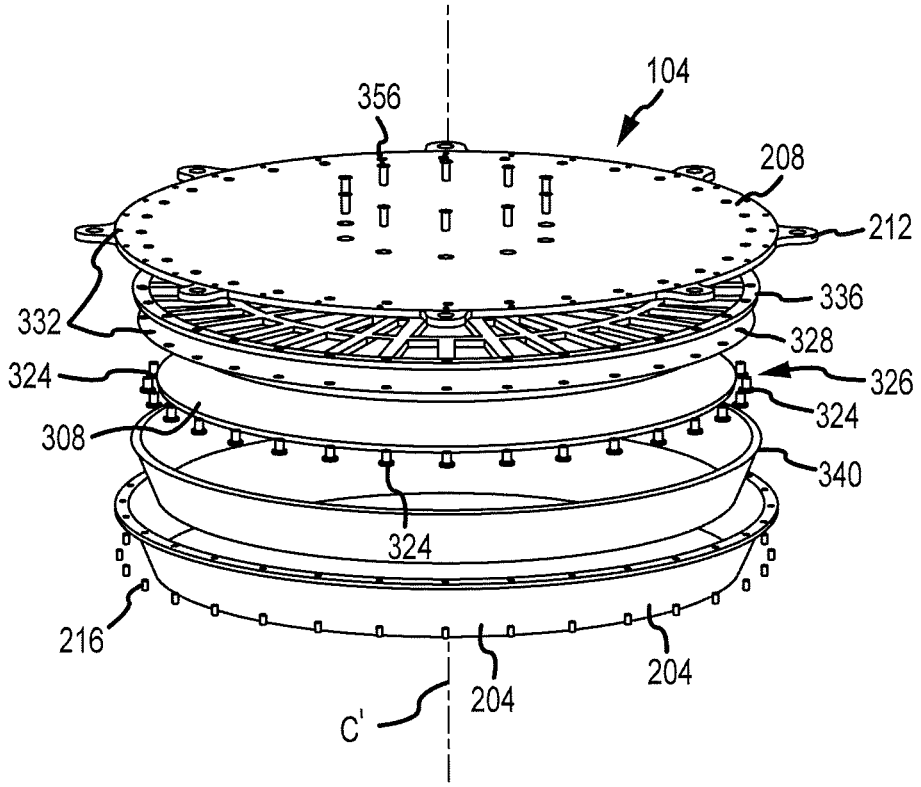
FIG. 4 is an exploded perspective view of components of an antenna system in accordance with embodiments of the present invention.

FIG. 4 is an exploded perspective view of components of an antenna system 104 in accordance with embodiments of the present invention. As shown in that figure, embodiments of the antenna system 104 can be formed from a relatively small number of components. In particular, the aperture or continuous flared radiator structure 334 is essentially formed from two components, the base plate 208 (or alternatively the PCB 328), which defines a ground plane 332, and the horn structure 308. Moreover, this simple construction nonetheless provides coverage in any direction with respect to the plane of the base plate 208. For instance, the beam 120 can be steered in any direction in azimuth.

Figure 5:
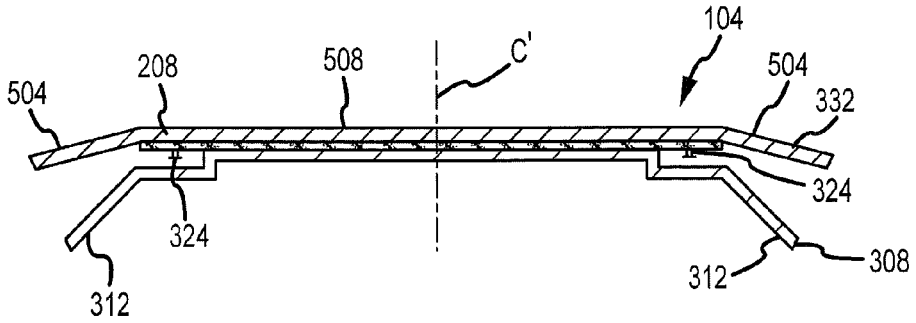
FIG. 5 is a cross-section in elevation of components of an antenna system in accordance with other embodiments of the present invention.

FIG. 5 is a cross-section in elevation of components of an antenna system 104 in accordance with other embodiments of the present invention. In this exemplary embodiment, the base plate 208 comprises a ground plane 332 that includes an angled outer portion 504 adjacent the flared radiator portion 312 of the horn structure 308. More particularly, the angled outer portion 504 is angled towards the horn structure 308. As can be appreciated by one of skill in the art after consideration of the present disclosure, the inclusion of an angled outer portion 504 of the ground plane 332 can alter the pointing and/or shaping of the beam produced by the antenna system 104. For example, where at least a central portion 508 of the base plate 208 and the waveguide portion 348 of the antenna system 104 are generally horizontal, the beam or beams formed by the antenna system 104 can be steered in azimuth. Moreover, by including the angled outer portion 504, the beam or beams produced by the antenna system 104 are pointed away from the plane of the base plate 208. Accordingly, in this example, the beam is pointed at a different angle in elevation as compared to the beam of the embodiment illustrated in FIG. 3.

Figure 6:
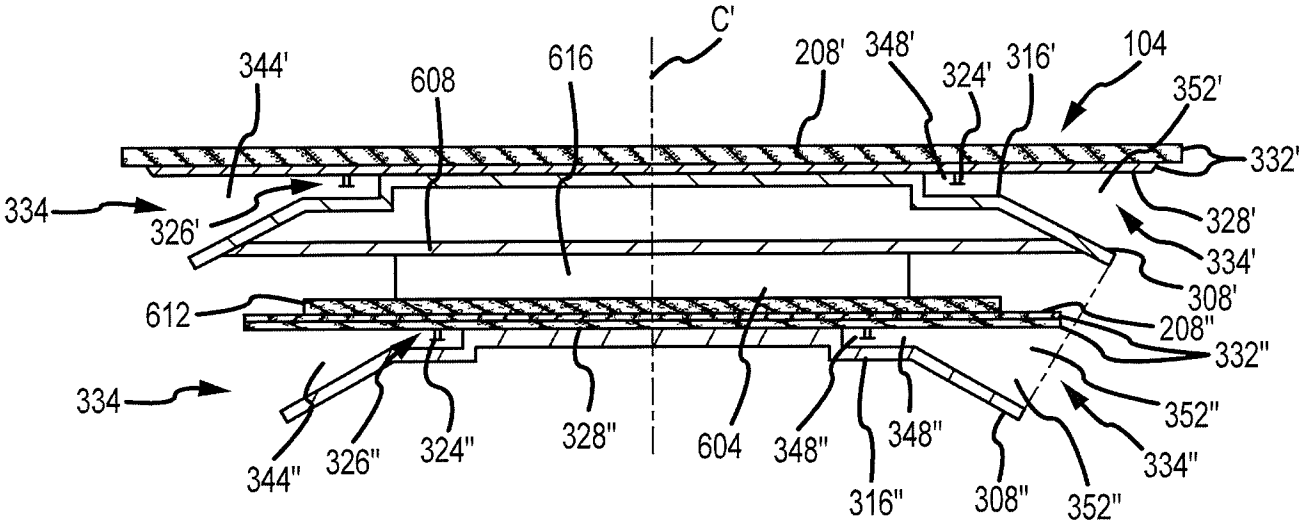
FIG. 6 is a cross-section in elevation of components of an antenna system in accordance with other embodiments of the present invention.

FIG. 6 is a cross-section in elevation of components of an antenna system 104 in accordance with other embodiments of the present invention. In this exemplary embodiment, the antenna system 104 includes two concentric continuous flared radiator structures 334. The first continuous flared radiator structure 334' includes a first ground plane 332' and a first horn structure 308'. As can be appreciated by one of skill in the art, the first continuous flared radiator structure 334' features a first waveguide portion 348' and a first flared radiator portion 352', and extends 360° about the central axis C' of the antenna system 104. A first plurality of probe feeds 324' comprising a first circular array 326' are interconnected to the first PCB 328'. A portion of each probe feed included in the first plurality of probe feeds 324' is disposed within the parallel plate waveguide portion 348' of the first continuous flared radiator structure 334'.

The second continuous flared radiator structure 334" generally includes a second ground plane 332" and a second horn structure 308". The second continuous flared radiator structure 334" includes a second waveguide portion 348" and a second flared radiator portion 352" and extends 360° about the central axis C' of the antenna system 104. A second plurality of probe feeds 324" comprising a second circular array 326" are interconnected to the second PCB 328". At least a portion of the probe feeds included in the second plurality of probe feeds 324" extend into the second parallel plate waveguide portion 348" of the second continuous flared radiator 334".

A bracket structure 604 may be provided to interconnect the first continuous flared radiator structure 334' and the second continuous radiator structure 334". The bracket structure 604 in the exemplary embodiment shown in FIG. 6 includes a top plate 608 that is interconnected to the first horn structure 308'. The top plate 608 is interconnected to a bottom plate 612 by a connecting structure 616. The bottom plate 612 is interconnected to the base plate 208" of the second continuous flared radiator structure 334". Alternatively, first horn structure 308' and second base plate 208" may be directly fastened together or fabricated as a single component to eliminate the need for connecting parts.

In this exemplary embodiment, the first continuous flared radiator structure 334' has a larger diameter than the second continuous flared radiator structure 334". As a result, the gain of the first continuous flared radiator structure 334' will generally be greater than the gain of the second continuous flared radiator structure 334". As can be appreciated by one of skill in the art after consideration of the present disclosure, providing multiple continuous flared radiator structures 334 can facilitate the provision of an antenna system 104 having expanded functionality. For example and without limitation, the first continuous flared radiator structure 334' can be configured to perform a receive function, while the second continuous flared radiator structure 334" can be configured to perform a transmit function. In accordance with still other embodiments, the first continuous flared radiator structure 334' can function over a wavelength range that is different than the second continuous flared radiator structure 334". In addition, although the multiple continuous flared radiator structure 334 antenna system 104 depicted in FIG. 6 includes two continuous flared radiator structures 334' and 334", a multiple continuous flared radiator 334 antenna system 104 can include more than two continuous flared radiator structures 334. Embodiments of the present invention having multiple continuous flared radiator structures 334 can also feature steering of the beam 120 in elevation, by providing continuous flared radiator structures 334 having different beam profiles in elevation. In particular, a beam produced by the antenna system 104 having a desired angle or coverage area in a plane perpendicular to a base plate 208 of the antenna system 104 can be produced by appropriately selecting the continuous flared radiator structure 334 used to produce the beam. In accordance with multiple continuous flared radiator structure 334 antenna systems 104, a single radome 204 can be used to enclose the aperture volumes 344' and 344". In addition, each of the multiple continuous flared radiator structure 334 can optionally include a polarizer 340 (see FIG. 3). Each flared radiator structure 334 may have an associated polarizer 340 to provide the same polarization or different polarizations. Alternatively, a single polarizer 340 can be fabricated to cover more than one flared radiator.

Figure 7:
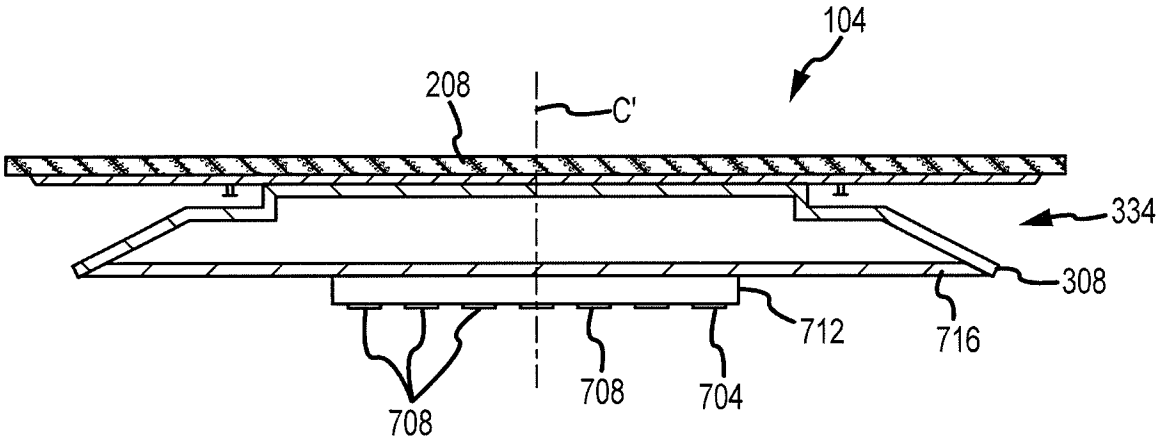
FIG. 7 is a cross-section in elevation of components of an antenna system in accordance with other embodiments of the present invention.

FIG. 7 is a cross-section in elevation of components of an antenna system 104 in accordance with other embodiments of the present invention. In this embodiment, a supplemental antenna element 704 is provided, in addition to the flared continuous radiator structure 334. The provision of a supplemental antenna element 704 can assist in providing an antenna beam that covers areas not covered by a beam or beams formed by the continuous flared radiator structure 334. For example, a supplemental antenna element 704 can provide coverage within areas along or near the central axis C' of the antenna system 104. In accordance with further embodiments, and as illustrated in FIG. 7, a supplemental antenna element 704 can comprise a plurality of radiating elements 708. Where a plurality of radiating elements 708 are provided, the supplemental antenna element 704 can comprise a phased array antenna. Moreover, the radiating element or elements 708 can be interconnected to a supplemental antenna element PCB 712 that is in turn interconnected to a mounting plate 716. The mounting plate 716 can function to interconnect the supplemental antenna system 704 to the horn structure 308 of the flared radiator structure 334. Moreover, the PCB 712 and/or the mounting plate 716 can function as a ground plane.

Figure 8:
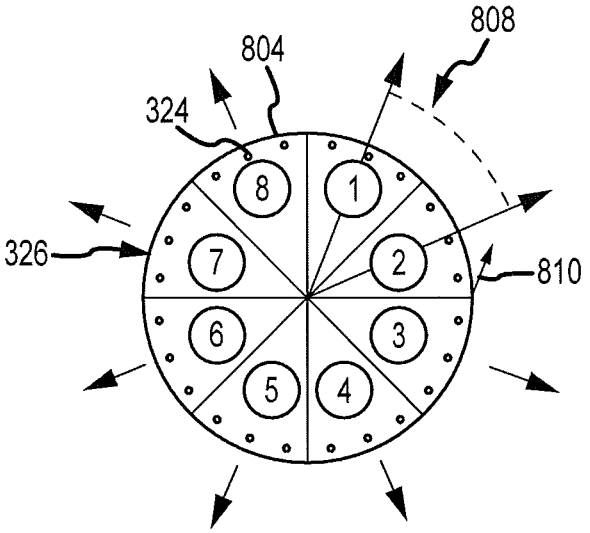
FIG. 8 depicts aspects of a feed network in accordance with embodiments of the present invention.

FIG. 8 depicts aspects of a feed network in accordance with embodiments of the present invention. More particularly, FIG. 8 illustrates an exemplary arrangement according to which the plurality of probe feeds 324 of a circular array 326 are divided into sectors 804. In this example, the probe feeds 324 are divided into eight groups or sectors 804 that each span 45° of the 360° flared radiator 334. According to such embodiments, a beam produced by the antenna system 104 can be steered or pointed in increments of 45°, by operating the feed network probe feeds 324 such that probe feeds 324 within two adjacent sectors 804 are operative at any one point in time. In accordance with embodiments of the present invention, by thus activating probe feeds 324 across a 90° section or segment of the continuous flared radiator 334 at any one point in time, the resulting beam can be electronically steered within a coverage area 808 centered in the 90° section. In addition, in accordance with embodiments of the present invention, the beam can be electronically steered within a 45° coverage area 808 by operating phase shifters. Accordingly, where the beam can be steered electronically by ±22.5°, the beam can be pointed in any direction around the flared radiator structure 334. This exemplary configuration provides a worst case scan angle of 67.5° for elements at the edge of the selected 90° section. Moreover, although a 45° coverage area 808 is depicted, coverage areas 808 that extend over areas of different angular extents can be selected by selectively switching segments of probe feeds that extend over sectors or areas of different sizes. Therefore, as further examples, and without limitation, a feed network that allows sectors that span 30° or 15° to be selected can be provided.

Figure 9:
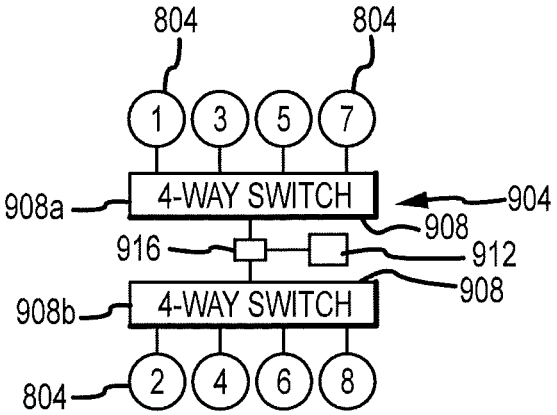
FIG. 9 depicts other aspects of a feed network in accordance with embodiments of the present invention.

FIG. 9 depicts features of a feed network 904 in accordance with embodiments of the present invention. In general, the feed network 904 includes a plurality of four-way switches 908. The four-way switches 908 allow the feed network 904 to address different subsets or sectors 804 of the probe feeds 324 to select the active coverage area 808 of the beam of the antenna system 104 so that the beam can then be electronically steered in a desired direction. Moreover, the four-way switches 908 that the sectors 804 of probe feeds 324 are connected to are alternated. For example, with reference again to FIG. 8, the probe feeds 324 in the odd numbered sectors 804 can be interconnected to the first four-way switch 908*a*, while the probe feeds 324 in the even numbered sectors 804 can be interconnected to the second four-way switch 908*b*. More particularly, the four-way switch 908*a* operates to interconnect a selected segment from a set of odd number sectors 804 of probe feeds 324 to transceiver electronics 912, while the second four-way switch 908*b* operates to interconnect a selected segment from a set of even number sectors 804 to be the transceiver electronics 912. A combiner/splitter 916 can be included to pass signals between the four-way switches 908 and the transceiver electronics 912. In accordance with embodiments of the present invention, transceiver electronics 912 can include a transceiver, transmitter, receiver, or the like.

Figure 10:
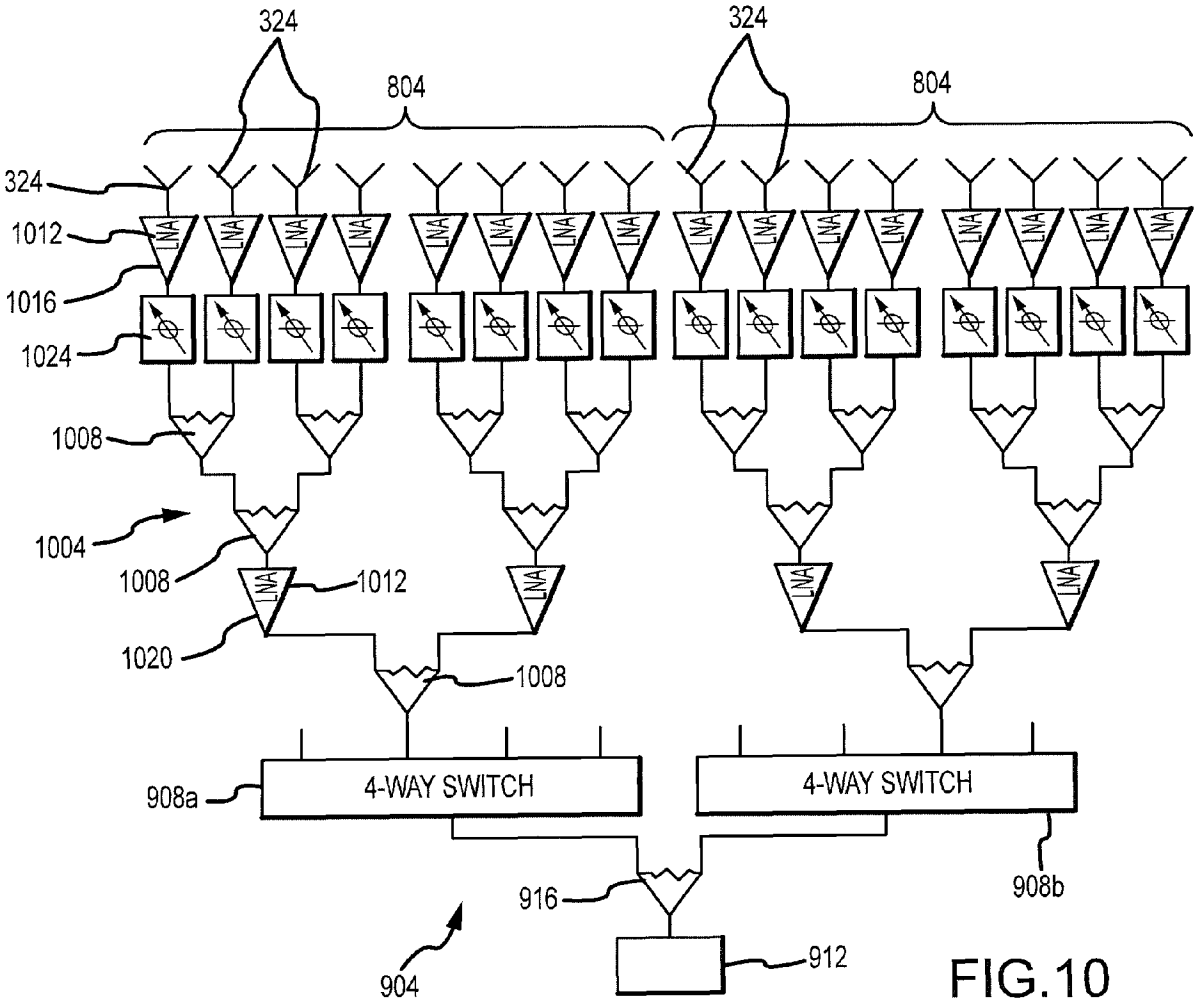
FIG. 10 is a block diagram of portions of a receive only feed network in accordance with embodiments of the present invention.

FIG. 10 is a block diagram of a receive only feed network 904 in accordance with exemplary embodiments of the present invention. In this example, one odd numbered segment 804 of probe feeds 324 and one even numbered segment 804 of probe feeds 324 are shown, interconnected to a selected output of a first four-way switch 908*a* and a selected output of a second four-way switch 908*b* respectively. In general, between the four-way switches 908 and the interconnected probe feeds 324 is a distribution network 1004 that includes a plurality of splitters 1008 and amplifiers 1012. Moreover, the amplifiers 1012 can include low noise amplifiers 1016, located proximate to the individual probe feeds 324, and buffer amplifiers 1020, that receive signals from a plurality of low noise amplifiers 1016. The distribution network 1004 can additionally include a plurality of phase shifters 1024, to support electronic steering of the beam within a selected coverage area 808. As can be appreciated by one of skill in the art, a transmit only feed network 904 can be provided by reversing the operative direction of the included amplifiers 1012, and operating the combiners 916 and 1008 as splitters. Moreover, one or more of the amplifiers 1012 can comprise power amplifiers.

Figure 11:
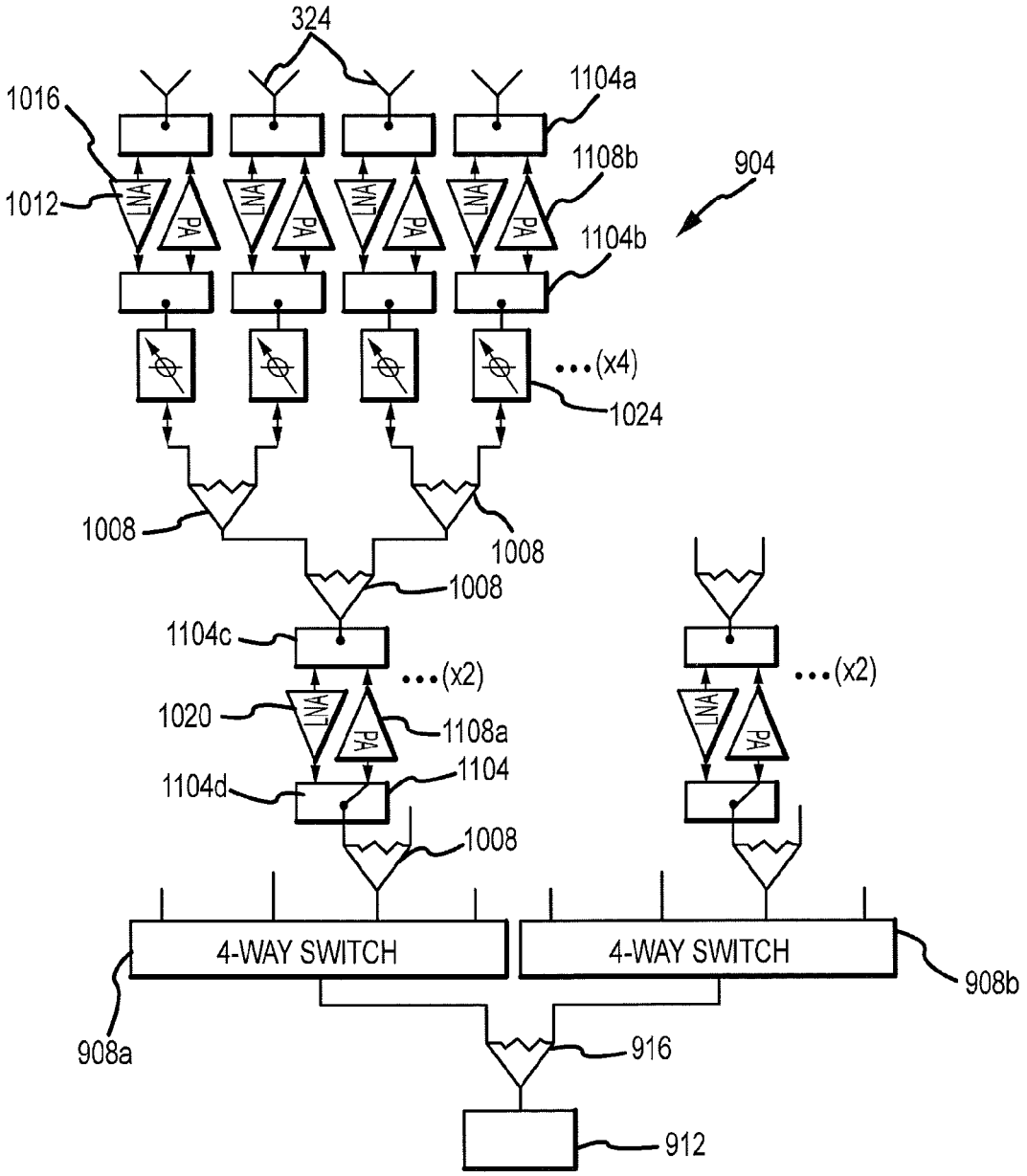
FIG. 11 is a block diagram of portions of a half duplex feed network system in accordance with embodiments of the present invention.

FIG. 11 is a block diagram of a half duplex feed network system 904 in accordance with embodiments of the present invention. In order to implement a half duplex system, switches 1104 are incorporated into the feed network 904, to selectively provide signals to amplifiers 1012. More particularly, in a receive mode, switches 1104*a* proximate to the probe feeds 324 provide received signals to low noise amplifiers 1016. Also in the receive mode of operation, a second set of switches 1104*b* pass signals from the low noise amplifiers 1016 to other components of the feed network 904. For example, the receive signals can be provided to phase shifters 1024. As can be appreciated by one of skill in the art after consideration of the present disclosure, the phase shifters 1024 can be operated to steer the receive beam of the antenna system 104. The receive signals are then passed through splitters/combiners 1008. The combined signal can be provided to a third switch 1104*c*, that passes the combined signal to a buffer amplifier 1020, and from there to other components of the feed network 904 through a fourth switch 1104*d*.

In a transmit mode of operation, the transceiver 912 provides signals for transmission by the probe feeds 324 to the feed network 904. For example, the signal provided by the transceiver 912 can be split in a splitter/combiner 916, and provided to four-way switches 908. Each four-way switch 908 provides the signal to a distribution network associated with the selected sector of probe feeds 324. In particular, the fourth switch 1104*d* can receive a signal from a connected four-way switch 908, and provide that signal to a driver amplifier 1108. The driver amplifier 1108 provides the now amplified signal to the third switch 1104*c*, which receives the amplified signal, passes it through a series of splitters 1008 to a plurality of second switches 1104*b*. As illustrated, the amplified and divided signals can be passed through phase shifters 1024. As can be appreciated by one of skill in the art after consideration of the present disclosure, the phase shifters 1024 can be operated to steer the transit beam of the antenna system 104. The third switches 1104*b* are operated to provide signals to second power amplifiers 1108*b*, proximate to the probe feeds 324. The first switches 1104*a* are set to receive signals from associated second power amplifiers 1108*b*, and to provide the amplified signal to the probe feeds 324.

Figure 12:
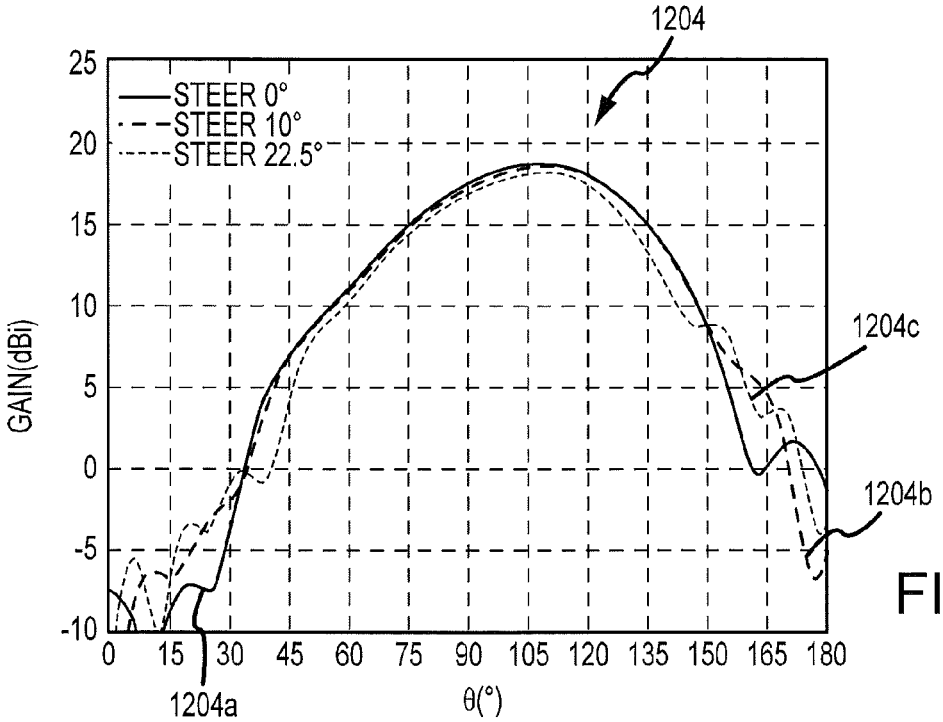
FIG. 12 depicts elevation patterns for beams steered in azimuth.

FIG. 12 depicts elevation patterns 1204 for beams produced by an antenna system 104 that are electronically steered within a coverage area 808 in accordance with embodiments of the present invention. In particular, the elevation pattern associated with a first beam 1204*a* steered at 0°, a second beam 1204*b* steered at 10°, and a third beam 1204*c* steered at 22.5° are illustrated. As shown in the figure, the beam pattern in elevation 1204 remains relatively constant, regardless of the angle in azimuth at which the beam produced by the antenna system 104 is steered.

Figure 13:
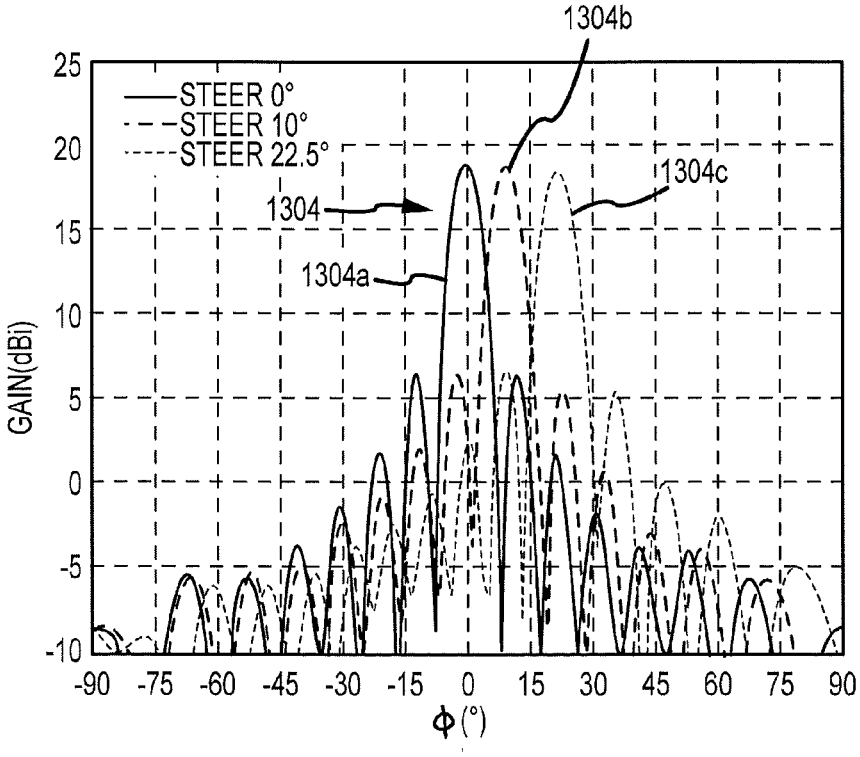
FIG. 13 depicts azimuth patterns for a beam steered in azimuth.

FIG. 13 depicts azimuth patterns 1304 for a beam that is electronically steered in azimuth within a selected coverage area 808 in accordance with embodiments of the present invention. In particular, a first beam 1304*a* steered at 0°, a second beam 1304*b* steered at 10°, and a third beam 1304*c* steered at 22.5° are shown. From the illustration, it can be appreciated that an antenna system 104 in accordance with embodiments of the present invention can produce beams that exhibit a relatively consistent pattern regardless of the direction in azimuth at which the beams are steered.

Figure 14:
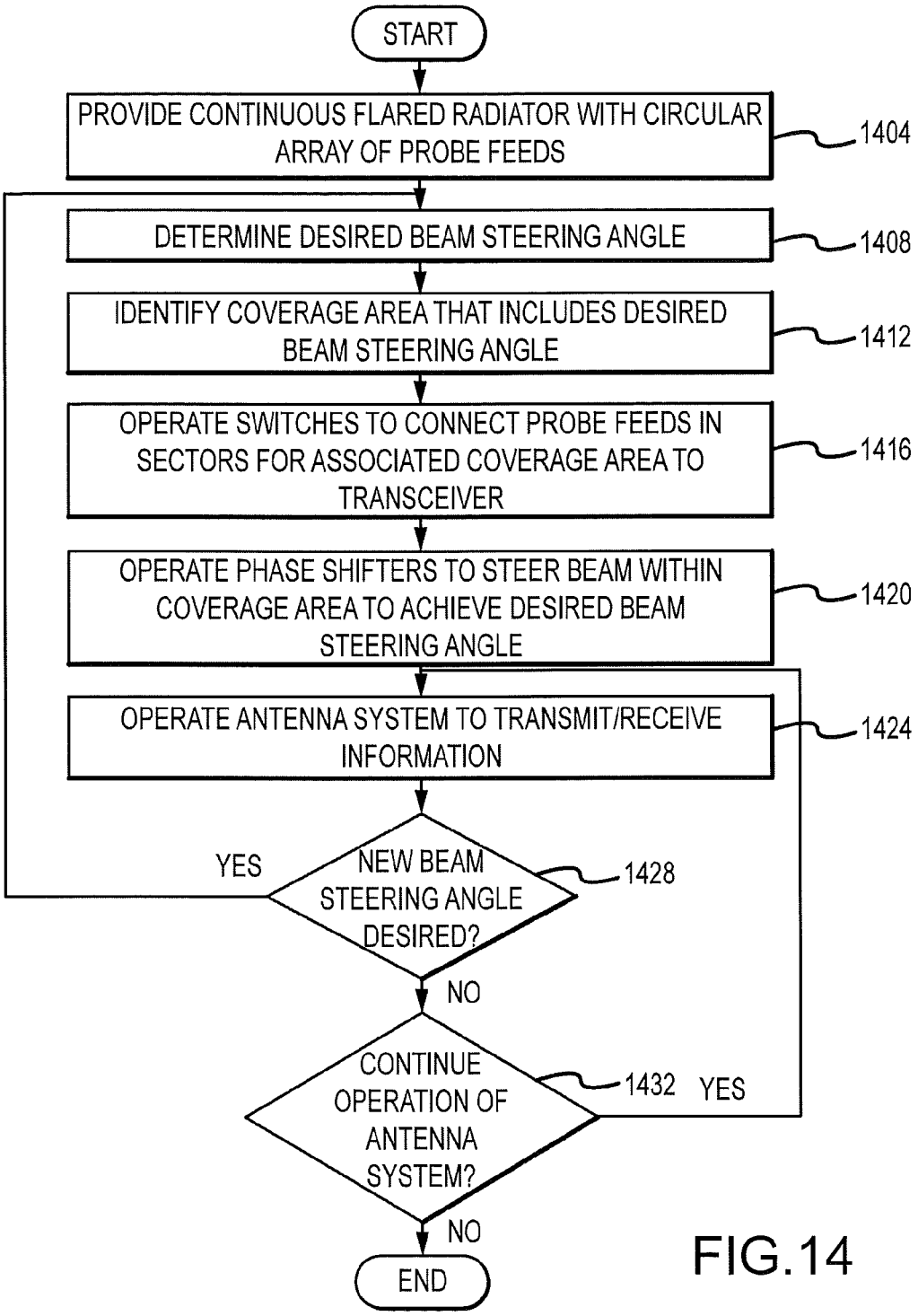
FIG. 14 depicts aspects of a method in accordance with embodiments of the present invention.

FIG. 14 is a flow chart depicting aspects of the operation of an antenna system 104 in accordance with embodiments of the present invention. Initially, at step 1404, a continuous flared radiator 334 with an associated circular array 326 of probe feeds 324 is provided. Next, the desired beam 120 steering angle is determined (step 1408). From the desired beam steering angle, the coverage area 808 that includes the desired beam 120 steering angle can be identified (step 1412). Having identified the coverage area 808 corresponding to the desired beam steering angle, switches 908 within the feed network 904 can be operated to interconnect the probe feeds 324 within sectors 804 corresponding to the beam coverage area 808 that includes the desired steering angle to the transceiver electronics 912 (step 1116). In order to steer the beam 120 within the operative coverage area 808, phase shifters 1024 can be operated (step 1420). In particular, and as can be appreciated by one of skill in the art, after consideration of the present disclosure, phase shifters 1024 associated with individual probe feeds 324 can be operated to taper the phase of the signal received by or transmitted by or from the probe feeds 324, to steer the resulting beam 120 within the operative coverage area 808. The antenna system 104 can then be operated to transmit and/or receive information (step 1124).

At step 1428, a determination may be made as to whether a new beam 120 steering angle is desired. If a new beam steering angle is desired, the process can return to step 1408. If a new beam steering angle is not desired, a determination can be made as to whether the operation of the antenna system 104 is to be continued (step 1132). If operation is to be continued, the process can return to step 1124. Alternatively, if operation of the antenna system 104 is to be discontinued, the process may end.

As described herein, an antenna system 104 in accordance with embodiments of the present invention can provide a beam 120 that is steered within a plane perpendicular to the central axis C' of the antenna system 104. Moreover, an antenna system 104 in accordance with embodiments of the present invention provides steering using a combination of a switching network to select the particular sector or sectors within which the beam 120 can be steered, and the selective alteration of the phase of signals passed through operative probe feeds 324. In accordance with further embodiments, steering of a beam in a plane perpendicular to the base plate 208 of the antenna system 104 can be achieved by providing multiple concentric continuous horn or flared radiator structures 334 having different profiles, and operating the probe feeds 324 and supporting feed network 904 components associated with a selected continuous flared radiator structure 334 included in the multiple continuous flared radiator structures.

As will be apparent to one of skill in the art after consideration of the present disclosure, embodiments of the present invention have particular application in connection with antenna systems 104 associated with mobile platforms 108, or with antenna systems 104 in communication with end points 112 that move relative to the antenna system 104. For example, an antenna system 104 can be deployed in connection with an unmanned aerial vehicle 108, and can operate to track a stationary or mobile endpoint antenna 116 that provides control information to such a vehicle 108, and that receives information from such a vehicle 108.

In accordance with an exemplary embodiment of the present invention, the continuous flared radiator 344 is operated in connection with a circular array 326 of probe feeds 324 that can be selectively operated according to the grouping or sector 804 that corresponds to a desired steering angle of the beam 120. As described herein, in one non-limiting example, two four-way switches 904 can be provided to selectively activate adjacent 45° sectors of the circular array 326, such that a 90° sector of probe feeds 326 is operative at any particular point in time. Moreover, the selected 90° sector of probe feeds 326 can effectively provide a beam 120 that is steered within a 45° coverage area 808 that is centered within the 90° active sector. This configuration allows the coverage area 808 to be moved in 45° steps around the circumference of the antenna system 104. Moreover, this configuration provides a 67.5° worst case scan angle 810 for elements at the edge of an active quadrant. As can be appreciated by one of skill in the art, different segmentation of the circular array 326 can be used for different applications and/or coverage area 808 extents. Moreover, it can be appreciated that steering within a selected coverage area 808 can be performed electronically through the selective activation of phase shifters. Accordingly, fine pointing or steering of a relatively narrow beam in azimuth can be achieved.

As can also be appreciated by one of skill in the art after consideration of the present disclosure, a continuous flared radiator structure 334 as described herein can provide a beam that is relatively narrow in azimuth, and relatively broad in elevation. Moreover, to the extent that beam coverage along or near the central axis C' of the antenna system 104 is desired, supplemental antenna elements 704 can be provided.

In accordance with exemplary embodiments of the present invention, the probe feeds 324 placed around the circular array 326 have a spacing of $\lambda_{HI}/2$ where $\lambda_m$ is the wavelength at the highest frequency of operation. This spacing allows grating-lobe free operation at all steering angles. Although up to half of the array 326 may be illuminated at one time, such a configuration requires that the probe feeds 324 near the edge of the operative segment have an effective steering angle of 90° from their respective boresight direction. This can result in significant impedance mismatch of the probe feeds and increased side lobe levels away from the desired direction of radiation. Accordingly, smaller active segments, for example 90° segments of the circular array, can be used to provide improved impedance matching and reduced side-lobe levels. Moreover, the use of two four-way switches in the division of the circular array 326 into 45° segments results in a relatively simple feed network 904, while allowing full azimuth coverage within the active coverage area 808. In particular, such a configuration requires electronic steering by plus or minus 22.5° in azimuth relative to the boresight direction. The resulting 67.5° maximum scan angle for probe feeds 324 at the edge of the active quadrant is feasible for a phased array antenna. Accordingly, embodiments provide such steering through the inclusion and operation of phase shifters 1024 as part of the feed network 904.

The azimuth beam width of an antenna system 104 in accordance with embodiments of the present invention is determined by the diameter of the continuous flared radiator 334 aperture and how much of the array 326 is illuminated. The elevation beam width and angle of maximum gain are controlled by the features of the flared radiator portion 352. As an example, flare heights can extend from 0.4 to 0.8 inches, with a continuous flared radiator 334 diameter of ten inches. Increasing flare height increases aperture size, resulting in higher gain and a narrower beam width. The angle of the flare can be used to alter the angle of the maximum gain. With a fixed height, increasing the flare angle moves the direction of maximum gain further below the horizon. Additionally, the pattern shape can be altered by changing the top surface of the radiator, for example by providing an angled outer portion 504 of the ground plane 332. By varying the overall diameter and flare characteristics, the radiation pattern can be optimized for a given platform 108 and link.

Increasing the diameter of the continuous flared radiator structure 334 and the number of probe feeds or elements 324 results in higher gain and narrower azimuth beam width. Exemplary aperture diameters are ten, fourteen, and eighteen inches. Exemplary numbers of probe feeds 324 are 64, 96, and 128, which corresponds to 16, 24, or 32 active elements 324 at any one point in time. The active aperture width for the three sizes is 7.1 inches, 9.9 inches, and 12.7 inches.

The antenna system 104 can be fabricated in a simple, cost effective manner. For example, the horn structure 308 and base plate 208 can be machined aluminum or other metal or can be a molded plastic part with suitable electrically conductive plating. A single printed circuit board 328 can contain the probe feeds 324, the transmit and receive electronics 912, combining feed networks 1,004, switches 908, and power/control electronics. The continuous flared radiator structure 334 and printed circuit board 328 can be attached to the base plate 208 with relief for the traces and components. The printed circuit board 328 can define the upper portion of the continuous flared radiator structure 334. Alternatively, the base plate 208 can serve as the upper portion of the radiator structure 334, which allows shaping of the element to control pattern characteristics such as beam width and peak gain angle. Where a supplemental antenna 704 is provided, it can comprise a separate component, or can be integrated into the printed circuit board 328.

An assembled antenna system 104 in accordance with embodiments of the present invention with a ten inch diameter radiator structure 334 and a 0.8 inch flare height can comprise a base plate diameter of 10.75 inches and an overall antenna system 104 thickness or height of 1.225 inches. Exemplary frequency ranges supported by the antenna system 104 are from twelve to twenty gigahertz, with a gain of 20 dB at 15 GHz.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An antenna system, comprising:

a first ground plane;

a first flared radiator, wherein an outer diameter of the first flared radiator is symmetrical about a center point, and wherein the first flared radiator and the first ground plane together define a first aperture;

a first circuit substrate, wherein at least portions of the first circuit substrate are between the first ground plane and the first flared radiator, wherein the first circuit substrate is a printed circuit board, wherein the at least portions of the printed circuit board lie along a first plane, wherein the first plane is located between the first ground plane and the first flared radiator, wherein no portion of the first ground plane extends across the first plane, and wherein no portion of the first flared radiator extends across the first plane;

a first plurality of probe feeds interconnected to the first circuit substrate, wherein the first plurality of probe feeds are arranged about a first circle that is centered on the center point of the first flared radiator forming a first circular array, wherein at least a portion of each probe feed in the first plurality of probe feeds is within a volume of the first aperture, and wherein the probe feeds included in the first plurality of probe feeds are divided into a plurality of subsets;

a first feed network, including:

a first switch;

a second switch, wherein the first switch is interconnected to a first half of the subsets of probe feeds, wherein the second switch is interconnected to a second half of the subsets of probe feeds, and wherein the subsets of probe feeds alternate such that the subsets of probe feeds interconnected to the first switch are interleaved with the subsets of probe feeds interconnected to the second switch;

a plurality of phase shifters, wherein the first feed network at least one of supplies signals to or receives signals from at least some of the probe feeds included in the first plurality of probe feeds, wherein the first feed network is operable to interconnect one or more selected subsets of the probe feeds included in the first plurality of probe feeds to at least first transceiver electronics, wherein the first feed network is operable to differentially vary a phase of a signal supplied to or received from at least two probe feeds included in the first plurality of probe feeds, wherein at least portions of the first feed network are formed on the first circuit substrate, wherein the first feed network is configured to one of transmit signals or receive signals, and wherein at least one of the first switch, the second switch, and the plurality of phase shifters of the first feed network are located on the printed circuit board between the first ground plane and the first flared radiator.

2. The antenna system of claim 1, further comprising:

at least a first supplemental antenna element, wherein the first supplemental antenna element is located outside of the first aperture and on a side of the first flared radiator opposite the first ground plane.

3. The antenna system of claim 2, wherein the first supplemental antenna element includes a plurality of planar antenna elements.

4. The antenna system of claim 2, wherein the first supplemental antenna element is within a plane that is parallel to the first ground plane.

5. The antenna system of claim 1, wherein the first feed network is controlled so that probe feeds included in the first plurality of probe feeds within an arc of no greater than 90° of the first circle are operable at any one point in time.

6. The antenna system of claim 1, wherein at a first point in time the first switch interconnects at least a first subset of probe feeds to the first transceiver electronics, and wherein at the first point in time the second switch interconnects at least a second subset of probe feeds to the first transceiver electronics.

7. The antenna system of claim 6, wherein the probe feeds are divided into eight subsets, wherein each subset of probe feeds spans a 45 degree arc of the first circle, and wherein the first and second switches are four-way switches.

8. The antenna system of claim 1, further comprising:

a first polarizer, wherein the first polarizer spans at least substantially all of an area between an outer circumference of the ground plate and an outer circumference of the flared radiator.

9. The antenna system of claim 1, further comprising:

a radome, wherein the radome defines a volume that houses at least the first flared radiator.

10. The antenna system of claim 1, wherein the first ground plane includes an angled outer portion.

11. The antenna system of claim 1, further comprising:

a second ground plane;

a second flared radiator, wherein an outer diameter of the second flared radiator is symmetrical about the center point, and wherein the second flared radiator and the second ground plane together define a second aperture;

a second circuit substrate, wherein at least portions of the second circuit substrate are between the second ground plane and the second flared radiator, and wherein the second circuit substrate is a printed circuit board;

a second plurality of probe feeds interconnected to the second circuit substrate, wherein the second plurality of probe fees are arranged about a second circle that is centered on the center point of the first flared radiator forming a second circular array, wherein at least a portion of each probe feed in the second plurality of probe feeds is within a second volume defined by the second aperture, and wherein the probe feeds included in the second plurality of probe feeds are divided into a plurality of subsets;

a second feed network, including:

a third switch;

a fourth switch, wherein the third switch is interconnected to a first half of the subsets of probe feeds of the second plurality of probe feeds, wherein the fourth switch is interconnected to a second half of the subsets of probe feeds of the second plurality of probe feeds, and wherein the subsets of probe feeds of the second plurality of probe feeds alternate such that the subsets of probe feeds interconnected to the third switch are interleaved with the subsets of probe feeds interconnected to the fourth switch;

a plurality of phase shifters, wherein the second feed network at least one of supplies signals to or receives signals from at least some of the probe feeds included in the second plurality of probe feeds, wherein the second feed network is operable to interconnect one or more selected subsets of the probe feeds included in the second plurality of probe feeds to at least first transceiver electronics, wherein the second feed network includes a plurality of phase shifters and is operable to differentially vary a phase of a signal supplied to or received from at least two probe feeds included in the second plurality of probe feeds, wherein at least portions of the second feed network are formed on the second circuit substrate, and wherein the second feed network is configured to one of transmit signals or receive signals, wherein a first one of the first feed network and the second feed network is configured to transmit signals, and wherein a second of the first feed network and the second feed network is configured to receive signals.

12. The antenna system of claim 11, wherein the first and second ground planes include angled outer portions, wherein the outer portion of the first ground plane is angled towards the first flared radiator, and wherein the outer portion of the second ground plane is angled towards the second flared radiator.

13. An antenna system, comprising:

a first ground plane;

a first continuous flared radiator structure centered about a central axis, the first continuous flared radiator structure including a waveguide portion and a flared radiator portion;

a planar first circuit board, wherein the planar first circuit board lies along a first plane, wherein at least portions of the first circuit board are located between the first ground plane and the first continuous flared radiator structure, wherein the at least portions of the planar first circuit board lie along a first plane, wherein the first plane is located between the first ground plane and the first continuous flared radiator structure, wherein no portion of the first ground plane extends across the first plane, and wherein no portion of the first continuous flared radiator structure extends across the first plane;

a first plurality of probe feeds arranged in a circular array centered about the central axis, wherein at least a portion of each probe feed included in the first plurality of probe feeds is within the waveguide portion of the first continuous flared radiator structure, wherein the first plurality of probe feeds includes a plurality of subsets of probe feeds, wherein each subset of probe feeds includes more than one probe feed, and wherein the probe feeds included in the plurality of probe feeds are electrically connected to and extend from at least some of the portions of the planar first circuit board located between the first ground plane and the first continuous flared radiator structure;

a first feed network formed on the planar first circuit board, the first feed network including:

a first switch, wherein the first switch is connected to at least first and third subsets of probe feeds included in the first plurality of probe feeds;

a second switch, wherein the second switch is connected to at least second and fourth subsets of probe feeds included in the first plurality of probe feeds;

at least a first plurality of phase shifters, wherein each probe feed in the first plurality of probe feeds is connected to at least one phase shifter in the first plurality of phase shifters, wherein the first feed network is configured to one of transmit and receive signals, and wherein at least one of the first switch, the second switch, and the plurality of phase shifters of the first feed network are located on the planar first circuit board between the first ground plane and the first continuous flared radiator.

14. The antenna system of claim 6, wherein the first and second subsets of probe feeds are adjacent to one another.

15. The antenna system of claim 1, wherein the first and second switches are four-way switches.

16. The antenna system of claim 1, wherein the first and second switches are at least four-way switches.

17. The antenna system of claim 13, further comprising:

a second ground plane;

a second continuous flared radiator structure centered about the central axis, the second continuous flared radiator structure including a waveguide portion and a flared radiator portion;

a second circuit board, wherein at least portions of the second circuit board are located between the second ground plane and the second continuous flared radiator structure;

a second plurality of probe feeds arranged in a circular array centered about the central axis, wherein at least a portion of each probe feed included in the second plurality of probe feeds is within the waveguide portion of the second continuous flared radiator structure, wherein the second plurality of probe feeds includes a plurality of subsets of probe feeds, and wherein each subset of probe feeds includes more than one probe feed;

a second feed network formed on the second circuit board, the second feed network including:

a third switch, wherein the third switch is associated with at least first and third subsets of probe feeds included in the second plurality of probe feeds;

a fourth switch, wherein the fourth switch is associated with at least second and fourth subsets of probe feeds included in the second plurality of probe feeds;

at least a second plurality of phase shifters, wherein each probe feed in the second plurality of probe feeds is associated with at least one phase shifter in the second plurality of phase shifters, wherein the second feed network is configured to a first one of transmit and receive signals, and the first feed network is configured to a second one of transmit and receive signals.

* * * * *